United States Patent [19]

Scott et al.

[11] Patent Number: 4,631,991

[45] Date of Patent: Dec. 30, 1986

[54] RATCHET WRENCH FOR SCAFFOLDING SCREW JACK

[75] Inventors: W. Thomas Scott, Lisle; Jerome Soukup, Brookfield, both of Ill.

[73] Assignee: The Ceco Corporation, Oak Brook, Ill.

[21] Appl. No.: 745,817

[22] Filed: Jun. 17, 1985

Related U.S. Application Data

[63] Continuation of Ser. No. 521,006, Aug. 8, 1983, abandoned.

[51] Int. Cl.[4] ..... B25B 13/00

[52] U.S. Cl. ..... 81/90.1; 81/176.2

[58] Field of Search ..... 81/58.2, 90.1, 176.1, 81/176.15, 176.2

[56] References Cited

U.S. PATENT DOCUMENTS 740,878 10/1903 Lewis ..... 81/90 B X 3,527,327 9/1970 McCreary ..... 81/58.2 UX

*Primary Examiner*—Roscoe V. Parker

*Assistant Examiner*—Debra S. Meislin

*Attorney, Agent, or Firm*—McDougall, Hersh & Scott

[57] ABSTRACT

A ratchet wrench for adjustment of scaffolding screw jacks. The wrench includes a head member having an asymmetrical passage of fixed dimension adapted to receive the scaffolding leg. Dog members or flippers are positioned adjacent the passage in the head and are retained for perpendicular pivotal rotation with respect to the head. Each flipper includes an engaging surface and a sloped relief surface. Gravity induces the downward rotation of the flippers permitting the driving engagement of the jack in a first direction while contact between the screw jack and sloped flipper relief surface urges the flipper upwardly facilitating the non-driving wrench return stroke. The flippers are symmetrically designed thereby facilitating the selective raising or lowering of the screw jack simply by positioning the wrench with the appropriate head surface facing upwardly.

11 Claims, 5 Drawing Figures

RATCHET WRENCH FOR SCAFFOLDING SCREW JACK

This application is a continuation of application Ser. No. 521,006, filed Aug. 8, 1983, now abandoned.

BACKGROUND OF THE INVENTION

The present invention relates to an open-end ratchet wrench and, more particularly, to a wrench for adjusting screw jacks associated with conventional scaffolding. The wrench is adapted to simultaneously engage one leg or vertical frame member of the scaffold structure and an arm member extending laterally from the screw jack thereby facilitating rapid and effortless adjustment or levelling of individual scaffolding legs.

The use of scaffolding comprising tubular metal frame legs interconnected by a plurality of cross-braces is well known within the building construction and maintenance trades. For example, scaffolding is commonly used to support troughs during the pouring of concrete. Scaffolding structures, assembled either from individual members or from pre-assembled sections, may extend in excess of one-hundred feet both laterally as well as vertically. In order to compensate for ground or building surface irregularities to establish the proper grade for concrete pouring, or to lower the scaffolding for removal, screw jacks are positioned as required throughout the scaffolding structure.

The present invention is particularly intended for use with lead-screw type jacks having an internally threaded collar and bearing member with integral opposed arm members. Rotation of the collar forces the lead-screw to advance or retract as appropriate. Heretofore, adjustment of such screw jacks has generally been accomplished by manually rotating the arm members in a circular path or, where extreme compressive loads are encountered, a pipe positioned axially over an arm member may be required to apply sufficient force to reposition the jack. Such adjustment methods have generally been found to require excessive time and are therefore considered unsatisfactory.

The ratchet wrench of the instant invention, however, is adapted for substantially instantaneous engagement with the screw jack and for rapid rotation of the jack collar without time consuming repositioning of the wrench following each stroke. More particularly, the present wrench incorporates an asymmetrical head geometry adapted to receive the leg or frame member of a scaffold therein and to retain such frame member in locking engagement during the forward or screw advancing stroke. No time consuming wrench adjustments are required.

Automatic engagement of the jack collar arm members is achieved by a plurality of flippers or dog-members spaced around the wrench head and retained for pivotal movement thereon. In particular, these flippers are oriented perpendicularly to the wrench head and are generally vertical during normal wrench use. In this manner, gravity acts to automatically pivot the flippers into operative engagement with the jack arms during the forward stroke while permitting the flippers to rotate harmlessly out of engagement during the return or backward wrench stroke. Thus, the instant wrench is adapted to effortlessly engage a scaffolding screw jack and to quickly raise or lower the jack by a succession of reciprocal strokes.

Wrenches specially designed to operate screw jacks are known to the art. Unlike many conventional general purpose wrenches, however, screw jack wrenches are typically designed to mate and function with a particular or limited variety of jacks. The instant wrench, for instance, is specially suited for use with scaffolding or similar screw jacks having a collar and collar arm members adapted for rotation on a lead-screw. Thus, wrenches adapted for use with other jacks simply do not function in the instant environment.

Another example of a specialized jack is shown in Lewis, U.S. Pat. No. 740,878, wherein a ratchet type screw jack wrench is disclosed having a single spring-loaded dog-member retained for pivotal movement between, and parallel to, spaced head members. The dog is specially adapted to engage annular ratchet teeth rigidly secured to the jack screw. It will be appreciated that the Lewis '878 jack wrench is necessarily limited for use with jacks specially equipped with annular ratchet teeth.

Other special purpose wrenches known to applicant but unsuited for scaffolding screw jacks include Thompson, U.S. Pat. No. 2,659,257; Humburg, U.S. Pat. No. 1,964,121; Allmon, U.S. Pat. No. 1,291,633; and Moore, U.S. Pat. No. 2,539,262. Thompson '257 shows a turnbuckle ratchet wrench utilizing a plurality of spring-loaded pawl members retained, as in Lewis '878, for pivotal movement between, and parallel to, spaced head members. The specialized teachings of Thompson '257 are limited and find no application to scaffolding screw jacks as shown herein.

The asymmetrical head of the spanner wrench disclosed in Humburg '121, while potentially adaptable for use with scaffolding screw jacks, does not contemplate the positioning or 'nesting' of a scaffolding leg within the opening provided in the head nor, importantly, does Humburg teach the instant arrangement whereby the particular head geometry was found to facilitate ratchet wrench operation. The other references are cited only to illustrate special purpose wrench structures but are not otherwise considered pertinent.

It is therefore an object of the present invention to provide a wrench specially adapted for use with scaffolding or similar screw jacks characterized by a rotatable element having an arm member to facilitate the rotation thereof. The wrench shall be easily positioned about the scaffolding leg or similar tubular member without need for wrench readjustment. Further, the wrench shall automatically engage the arm members of the jack for rotation in a first direction and automatically disengage the arm members in the second or return direction thereby facilitating the ratchet type operation of the wrench. The wrench shall be adapted to permit either the raising or lowering of the screw jack simply and automatically by properly positioning the wrench with respect to the jack.

DESCRIPTION OF THE PREFERRED EMBODIMENT

Figure 1:
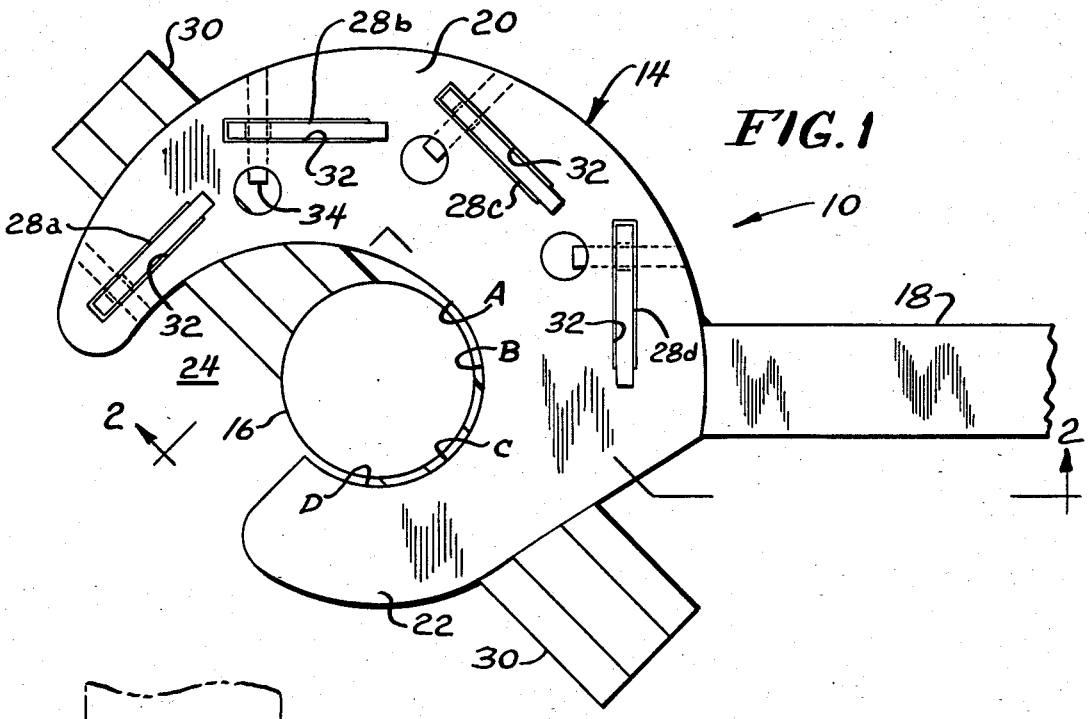
FIG. 1 is a top plan view of the ratchet screw jack wrench of the present invention shown in engagement with the screw jack for clockwise rotation thereof.

The screw jack wrench of the present invention, shown generally at 10 of FIG. 1, includes a head 14 adapted to receive a scaffolding frame or leg member 16 therein and a handle 18 to urge the rotation of the head 14 about leg member 16. The wrench may be alternatively positioned either as shown in FIG. 1 with the principal finger 20 of head 14 extending in the counterclockwise direction around leg 16 or the wrench may be inverted with finger 20 extending in the clockwise direction therearound. As will be described in more detail below, the above alternative wrench positions selectively determine the direction of jack lead-screw travel.

A pair of dissimilarly shaped finger members 20 and 22 are integrally formed to create the generally U-shaped but asymmetrical wrench head 14. These fingers define a generally L-shaped passage 24 in the head having a semi-circular terminus 26. Passage 24 functions to receive and securely engage the scaffolding leg 16 during driving engagement of the screw jack.

The larger or principal finger 20 of head 14 carries four pivotally mounted flippers or dogs 28 adapted, as discussed below, to engage an arm member 30 comprising a portion of a screw jack collar member. The smaller finger 22 functions, as discussed, to maintain engagement between the head 14 and the scaffolding leg 16 during the screw jack forward or driving stroke. This is considered in more detail below.

Figure 2:
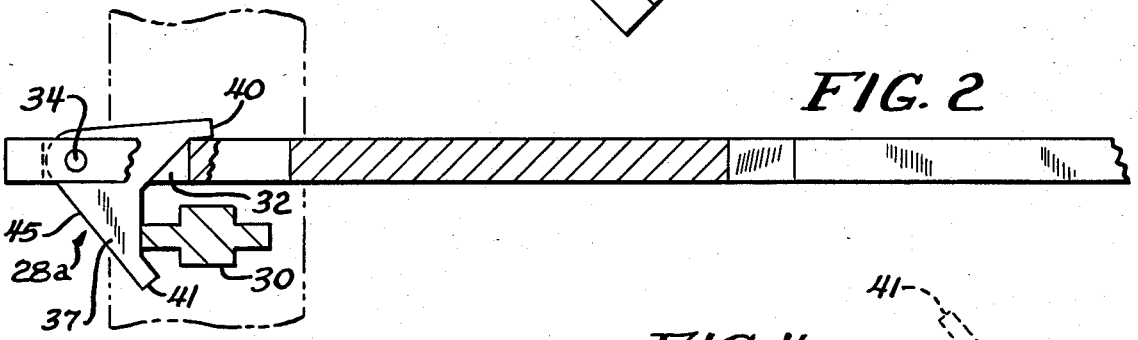
FIG. 2 is a sectional view taken along line 2—2 of FIG. 1 showing engagement between a flipper member of the wrench and the jack arm.

As best illustrated in FIGS. 1 and 2, elongated rectangular slots or apertures 32 extending through head 14 are provided to receive and retain flippers 28 for reciprocal rotation about pivot pins 34. The slots 32 are spaced substantially uniformly around finger 20 of head 14 such that engagement of the respective flippers 28 with the jack arm 30 occurs at correspondingly spaced discrete angular positions of the wrench relative to the screw jack arm member. More particularly, the spacing between the respective flippers 28 provides four discrete jack engagement positions each separated by a 45 degree rotation of the wrench 10. It will be appreciated that the above arrangement of spaced flippers 28 assures engagement of the wrench with one of the jack arms within 45 degrees of any initial wrench position.

Figure 3:
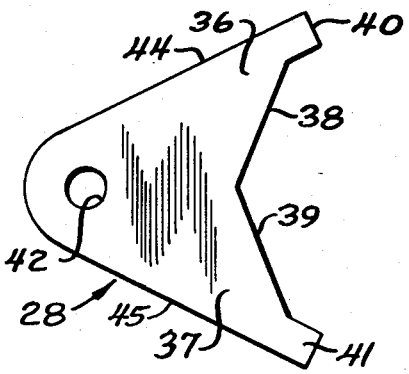
FIG. 3 is a side elevation view of a symmetrical wrench flipper member.
Figure 5:
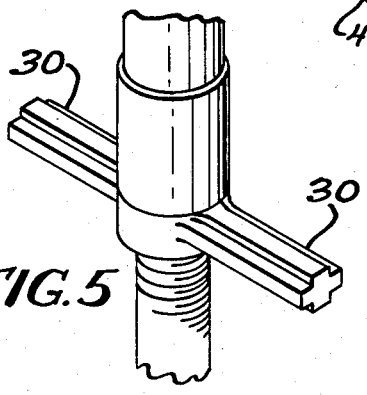
FIG. 5 illustrates a typical scaffolding screw jack assembly for which the wrench of the present invention is particularly suited.

Referring to FIG. 3, flippers 28 are fabricated from flat steel stock and include a symmetric arrangement of opposed projection members 36,37 each defining a jack arm engagement surface 38,39, a sloped relief surface 44,45, and a pivot stop 40,41. A hole 42 is provided through each flipper 28 to receive a pin 34 for pivotal rotation thereon. As best illustrated in FIGS. 1 and 2, the flippers are retained in perpendicular relationship to wrench head 14 within slots 32. Flippers 28 are positioned within slots 32 such that stops 40, 41 are respectively positioned on opposed sides of wrench head 14. Slots 32 are dimensioned to block passage of stops 40,41 thereby limiting the free rotation of flippers 28. When the wrench is positioned as shown in FIGS. 1 and 2, generally parallel to the ground, flippers 28 rotate downwardly until stops 40 contact the wrench head 14 thereby exposing flipper projection members 37 and associated contact surfaces 38 below the head. As the wrench is rotated in a clockwise direction, as viewed from above, one of the flippers 28 will engage the jack arm 30 forcing the clockwise motion thereof. The driving force acting upon flipper surface 39 maintains the flipper stop 40 in rigid contact with wrench head 14 thereby precluding further rotation of the flipper.

When a particular forward or clockwise stroke is complete, the wrench may be rotated in the counterclockwise or return direction without interference from the flippers. During the return stroke the jack arm 30 successively contacts the sloped relief surfaces 45 of flippers 28 causing the flippers to pivot upwardly out of the way as shown by the dotted flipper of FIG. 4. In this manner, the wrench of the instant invention may be reciprocated to provide for the continuing displacement of the jack lead-screw or collar without the time consuming requirement to reposition the wrench following each forward stroke.

Figure 4:
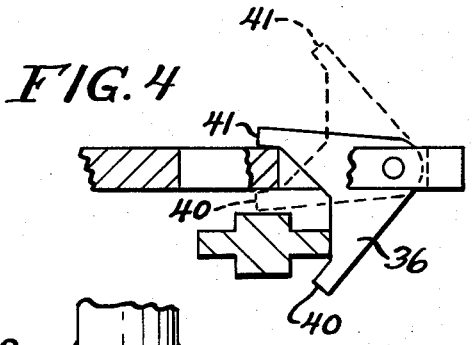
FIG. 4 is a fragmentary sectional view substantially along line 2—2 of FIG. 1 but illustrating engagement of the flipper and jack arm when the wrench is positioned for counterclockwise rotation oppositely from that shown in FIG. 1. The flipper shown by dotted lines illustrates the upwardly rotated position of the flipper during the return ratchet stroke.

It will be appreciated that driving engagement of the screw jack in the opposite or counterclockwise direction is effortlessly effected without wrench readjustment simply by turning the wrench over and repositioning the wrench on the screw jack leg. The pivotally mounted flippers 28 will, as before, pivot downwardly under the force of gravity thereby exposing the opposed flipper projections 36 and engagement surfaces 38 as shown in FIG. 4. In this second position, the counterclockwise driving force acting upon flipper surface 38 maintains flipper stop 41 in rigid contact with the wrench head 14 thereby precluding further rotation of the flipper. A clockwise rotation of the wrench, however, again causes the flippers to successively rotate upwardly out of the way under the force of jack arm 30 acting upon the sloped surfaces 44.

The wrench of this invention advantageously incorporates an asymmetrical head 14 adapted to retain four spaced flippers in spaced relationship around a first larger finger 20 of the head. The second finger 22 is dimensioned to be substantially smaller than the first finger thereby creating a passage 24 between the fingers. However, finger 22 must be of sufficient size and shape to assure proper retention of the screw jack without regard to which of the four flippers is engaged. In particular, the end of finger 22 must extend outwardly beyond a screwjack centerline, defined in the plane of the wrench perpendicular to the axis of jack handle 18, to preclude inadvertent withdrawal of the wrench which has been found to otherwise occur when flipper **28*d*** is in engagement with the jack handle.

Driving engagement of the screw jack requires that the wrench apply an angular or torsional moment or force to the jack. This torsional moment is directly attributable to equal but opposite forces generated as the wrench is urged into circular motion. The first force is that of the flipper acting in a generally perpendicular direction to the screw jack arm. The second and opposite force is that of the head acting radially inwardly on the screw jack leg. The precise points of contact between the wrench head and the screw jack leg varies depending on which flipper is engaged. The points of contact lay along the semi-circular surface 26 generally defining the inner portion of finger 22. Points A, B, C and D define the approximate positions where the wrench head contacts and acts upon the screw jack for respective engagement with flippers **28*a, b, c, d*. It can be seen that finger 22 must extend beyond contact point 'D' to assure proper retention of the screw jack when flipper 28***d* is engaged.

The scaffolding screw jack wrench of the instant invention advantageously utilizes dog members or flippers retained in perpendicular relationship to the wrench head thereby facilitating the gravity actuation of the flippers to provide automatic ratchet operation as well as automatic drive reversal simply by repositioning the wrench about the screw jack. Since no return or biasing springs are required, enhanced reliability and ease of operation are achieved at lower cost. Further, the asymmetrical head of this invention is particularly suited to receive and retain the screw jack leg member therein during driving engagement while being adapted for effortless positioning or removal without adjustment or other time consuming steps. Further, the use of flippers uniformly spaced around an enlarged portion of the head enhances the ease of wrench use by assuring wrench-jack engagement within a relatively small angular wrench displacement (approximately 45 degrees) from any initial wrench position. This feature is advantageous both for initial screw jack engagement as well as during ratchet operation of the wrench.

What is claimed:

1. A wrench for advancing a rotatable collar member of a screw jack along a vertically disposed jack lead screw, the collar member having at least one arm member extending radially outwardly therefrom, the wrench including:

(a) head means defining opposed first and second surfaces and having a passage adapted to receive the screw jack with either of said surfaces facing substantially downwardly;

(b) handle means connected to the head means for rotating the head means around the screw jack when said jack is in the passage;

(c) at least one flipper means for selectively engaging the jack arm member;

(d) means for attaching the flipper means for pivotal rotation on the head means such that the flipper means generally rotate downwardly below the head means, the pivotal flipper means defining a plane of rotation substantially perpendicular to said surfaces of the head means when the head means is positioned to receive the screw jack in said passage whereby rotation of the head means in a first direction forces said selective engagement of the arm member thereby causing the corresponding rotation of the collar member and rotation of the head means in the opposed second direction forces the flipper means to pivotally rotate upwardly above the head means thereby precluding both the selective engagement of the jack arm member and the rotation of the collar member;

whereby said direction of rotation of the collar member determined by selectively positioning said first or second head means surface downwardly.

2. The screw jack wrench of claim 1 wherein the flipper means includes symmetric first and second integral projection members in opposed relationship about a flipper centerline and wherein the means for attaching the flipper means includes a pivot pin through the flipper means at one end of the centerline whereby the force of gravity normally pivots the flipper means downwardly exposing the first projection member below the head means when the first surface thereof is facing downwardly and exposing the second projection member below the head means when the second surface thereof is facing downwardly.

3. The screw jack wrench of claim 2 wherein the projection members of the flipper means include stop means limiting the downward pivotal rotation of the flipper means.

4. The screw jack wrench of claim 2 wherein each projection member includes a driving surface and a relief surface whereby contact between the arm member and the driving surface causes rotation of the jack collar member during rotation of the head means in one direction while contact between the arm member and the relief surface causes the flipper means to pivot upwardly from driving engagement with the arm member during rotation of the head means in the reverse direction.

5. The screw jack wrench of claim 1 wherein the means for attaching the flipper means includes aperture means extending between said first and second surfaces of the head means; a pivot pin through each flipper means; recesses in the head means adjacent each aperture adapted to receive and retain the pivot pin whereby the flipper means may pivot outwardly of the first and second head means surfaces.

6. The screw jack wrench of claim 5 wherein the opposed first and second surfaces of the head means are substantially flat and in substantially parallel relationship.

7. The screw jack wrench of claim 6 wherein the pivot pin has an axis disposed substantially parallel to the axis of the jack arm member when the corresponding flipper means is in driving engagement with the arm member.

8. The screw jack wrench of claim 1 including a plurality of flipper means spaced in the head means such that engagement of the jack arm member by each of the flipper means defines a different angular relationship between the head means and the jack arm member.

9. The screw jack wrench of claim 8 wherein the different angular relationship defined by adjacent flipper means is between about 10 and 100 degrees.

10. The screw jack wrench of claim 1 wherein the head means includes a major finger member adapted to receive a plurality of spaced flipper means and a minor finger member adapted to engage the screw jack and to retain proper seating thereof within the head means passage during driving engagement of the jack arm member by one of said flipper means.

11. A ratchet wrench for a scaffolding screw jack having a threaded lead screw and a threaded collar adapted for rotation thereon to advance the collar along the screw, said collar having at least one arm member extending generally radially outwardly from the collar; the wrench comprising a head member and integral handle means; the head member lying substantially along a plane and being generally U-shaped and defining a jack-receiving passage and jack-engaging position therein; flipper means having opposed first and second stop means and first and second jack arm member engaging surfaces and first and second sloped surfaces; at least one slot through the head member adapted to receive the flipper means, the slot having a longitudinal axis substantially perpendicular to a line intersecting a first end of the slot, said line radiating generally outwardly from a point defining the center of the pipe engaging position, means for pivotally mounting the flipper means within the slot substantially perpendicular to the plane of the head member, the means defining an axis of rotation in said plane substantially through the second end of the slot, the flipper means being retained by the mounting means within the slot such that respective stop means are positioned on opposed sides of the head member, said stop means adapted to permit limited pivotal rotation of the flipper means between first and second positions wherein the respective first and second stop means engage the head member, whereby when the head member engages a scaffolding jack in substantially parallel alignment with respect to the ground, the flipper means automatically pivots downwardly until one of the flipper stop means contacts the head member and one of said jack arm engaging surfaces and sloping surfaces extends below the head member whereby rotation of the wrench and head member in a first direction causes the engaging surface to engage the jack arm causing the rotation of the arm while rotation in the second or reverse direction causes the arm to contact the sloped flipper surface thereby urging the flipper upwardly precluding rotation of the jack arm.

* * * * *